US009010756B2

(12) United States Patent
Akimatsu

(10) Patent No.: US 9,010,756 B2
(45) Date of Patent: Apr. 21, 2015

(54) SHEET FEEDER

(71) Applicant: Takayuki Akimatsu, Nagoya (JP)

(72) Inventor: Takayuki Akimatsu, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/168,404

(22) Filed: Jan. 30, 2014

(65) Prior Publication Data

US 2014/0210160 A1 Jul. 31, 2014

(30) Foreign Application Priority Data

Jan. 31, 2013 (JP) ..... 2013-016350

(51) Int. Cl.
*B65H 5/06* (2006.01)

(52) U.S. Cl.
CPC ..... *B65H 5/06* (2013.01)

(58) Field of Classification Search
USPC ..... 271/274, 272; 492/16, 18, 60; 384/301
See application file for complete search history.

(56) References Cited

U.S. PATENT DOCUMENTS

| | | | | |
|---|---|---|---|---|
| 4,486,258 | A * | 12/1984 | Schrotz et al. | 156/384 |
| 5,600,426 | A * | 2/1997 | Gramlich et al. | 399/381 |
| 5,606,357 | A * | 2/1997 | Bekki | 347/104 |
| 6,325,560 | B1 * | 12/2001 | Hirabayashi et al. | 400/636 |
| 6,626,596 | B2 * | 9/2003 | Hirabayashi et al. | 400/636 |
| 7,677,562 | B2 * | 3/2010 | Ishihara et al. | 271/272 |
| 7,955,013 | B2 * | 6/2011 | Ortiz | 400/641 |
| 7,971,990 | B2 * | 7/2011 | Terao et al. | 347/104 |
| 8,505,914 | B2 * | 8/2013 | Tashiro | 271/264 |
| 2004/0190972 | A1 * | 9/2004 | Kawai | 400/636 |
| 2004/0236061 | A1 | 11/2004 | Fujita et al. | |
| 2004/0245715 | A1 * | 12/2004 | Zheng | 271/274 |
| 2006/0163803 | A1 * | 7/2006 | Izuchi et al. | 271/272 |
| 2012/0153567 | A1 * | 6/2012 | Sawamura et al. | 271/272 |

FOREIGN PATENT DOCUMENTS

| | | | |
|---|---|---|---|
| JP | 9-278221 | A | 10/1997 |
| JP | 2004-346121 | A | 12/2004 |
| JP | 2006-151620 | A | 6/2006 |

* cited by examiner

*Primary Examiner* — Patrick Cicchino
(74) *Attorney, Agent, or Firm* — Merchant & Gould PC

(57) ABSTRACT

A sheet feeder is provided that includes a driving roller, a driven roller configured to rotate in accordance with rotation of the driving roller and feed a sheet while pinching the sheet with the driving roller, an elastic shaft inserted through the driven roller and configured to rotatably support the driven roller, the elastic shaft including a protrusion formed on at least one end of the elastic shaft in an axial direction of the elastic shaft, the protrusion protruding outward in a radial direction of the driven roller, and two recess-shaped bearings configured to support two end portions of the elastic shaft in the axial direction, respectively, at least one of the bearings including a contact surface configured to contact the protrusion when the elastic shaft is supported by the bearings.

8 Claims, 7 Drawing Sheets

SHEET FEEDER

CROSS-REFERENCE TO RELATED APPLICATION

This application claims priority under 35 U.S.C. §119 from Japanese Patent Application No. 2013-016350 filed on Jan. 31, 2013. The entire subject matter of the application is incorporated herein by reference.

BACKGROUND

1. Technical Field

The following description relates to one or more techniques for a sheet feeder that includes a driving roller and a driven roller configured to rotate in accordance with rotation of the driving roller and feed a sheet while pinching the sheet with the driving roller.

2. Related Art

A sheet feeding mechanism has been known in which a driven roller is rotatably supported by an elastic shaft such as a contact coil spring, and is pressed against a driving roller. Further, a different sheet feeding mechanism has been known in which hooks are provided at two ends of a coil spring as an elastic shaft, and a driven roller is attached to a supporting body with the hooks of the coil spring being hung on pins provided at the supporting body.

SUMMARY

In the known sheet feeding mechanism, the elastic shaft rotates in response to rotation of the driven roller. Therefore, undesired noises are generated when the elastic shaft comes into sliding contact with bearing portions that support both end portions in an axial direction of the elastic shaft. On the other hand, in the known different sheet feeding mechanism, it is possible to prevent rotation of the elastic shaft since the hooks of the elastic shaft are hung on the pins. However, when the driven roller is attached to the supporting body, required is a troublesome operation of hanging the hooks on the pins.

Aspects of the present invention are advantageous to provide one or more improved techniques, for a sheet feeder, which make it possible to prevent rotation of an elastic shaft and to easily attach a driven roller.

According to aspects of the present invention, a sheet feeder is provided, which includes a driving roller, a driven roller configured to rotate in accordance with rotation of the driving roller and feed a sheet while pinching the sheet with the driving roller, an elastic shaft inserted through the driven roller and configured to rotatably support the driven roller, the elastic shaft including a protrusion formed on at least one end of the elastic shaft in an axial direction of the elastic shaft, the protrusion protruding outward in a radial direction of the driven roller, and two recess-shaped bearings configured to support two end portions of the elastic shaft in the axial direction, respectively, at least one of the bearings including a contact surface configured to contact the protrusion when the elastic shaft is supported by with the bearings.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompanying drawings. It is noted that, in the following descriptions, a front side, a rear side, a left side, a right side, an upside, and a downside will be defined as shown in the accompanying drawings.

<General Configuration of ADF>

Figure 1:
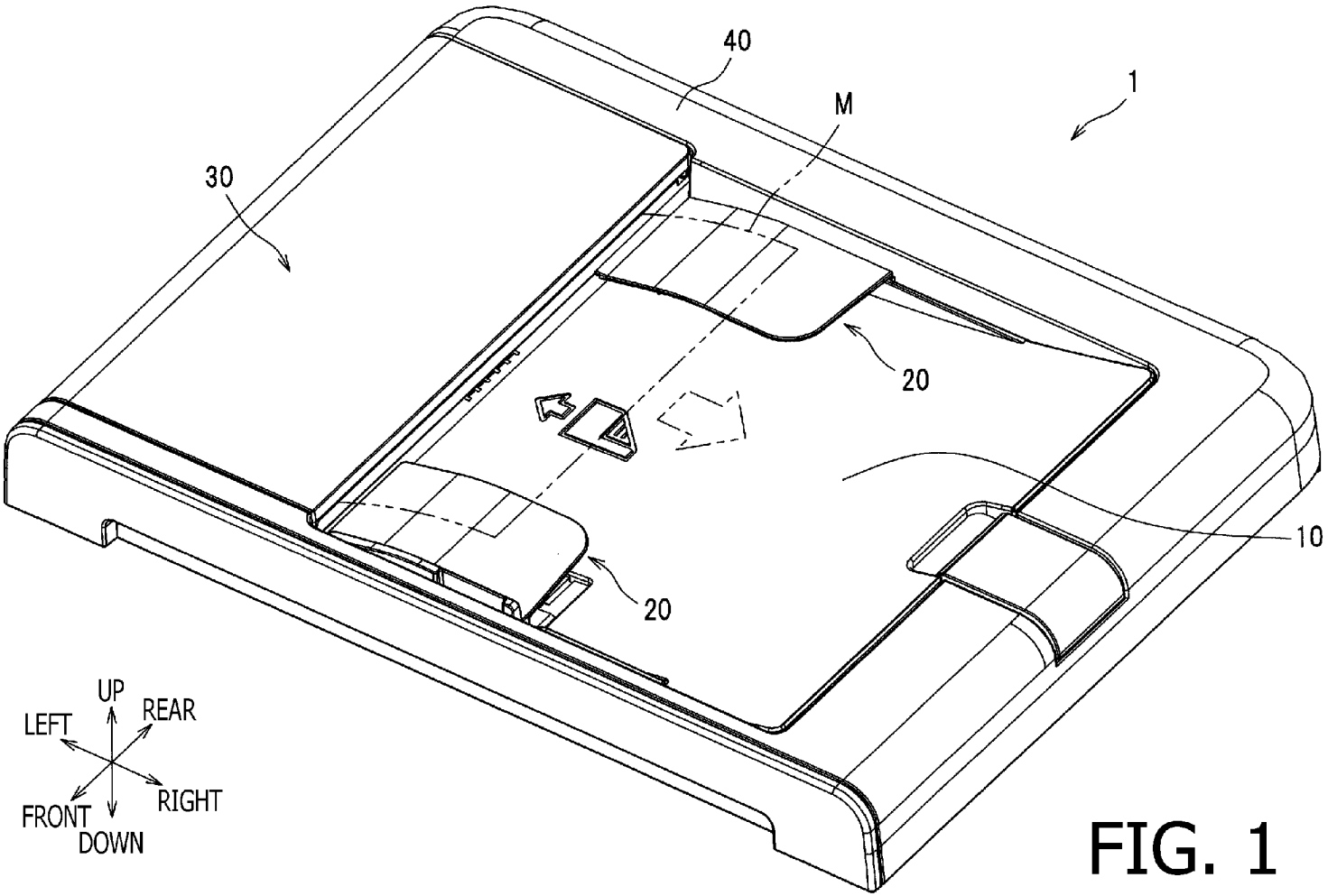
FIG. 1 is a perspective view showing an automatic document feeder (hereinafter which may be referred to as an ADF) in an embodiment according to one or more aspects of the present invention.

Initially, an explanation will be provided about a general configuration of an automatic document feeder (hereinafter which may be referred to as ADF) 1 in the embodiment. The ADF 1 shown in FIG. 1 is disposed above a known flatbed scanner (not shown) and configured to be openable and closable relative to a document table of the flatbed scanner. The ADF 1 includes a feed tray 10, a catch tray 20, and a document feeding unit 30. The feed tray 10 is configured to support a document sheet M set thereon. The catch tray 20 is disposed above the feed tray 10 and configured to receive the document sheet M ejected thereon. The document feeding unit 30 is configured to feed the document sheet M from the feed tray 10 toward the catch tray 20.

Figure 2:
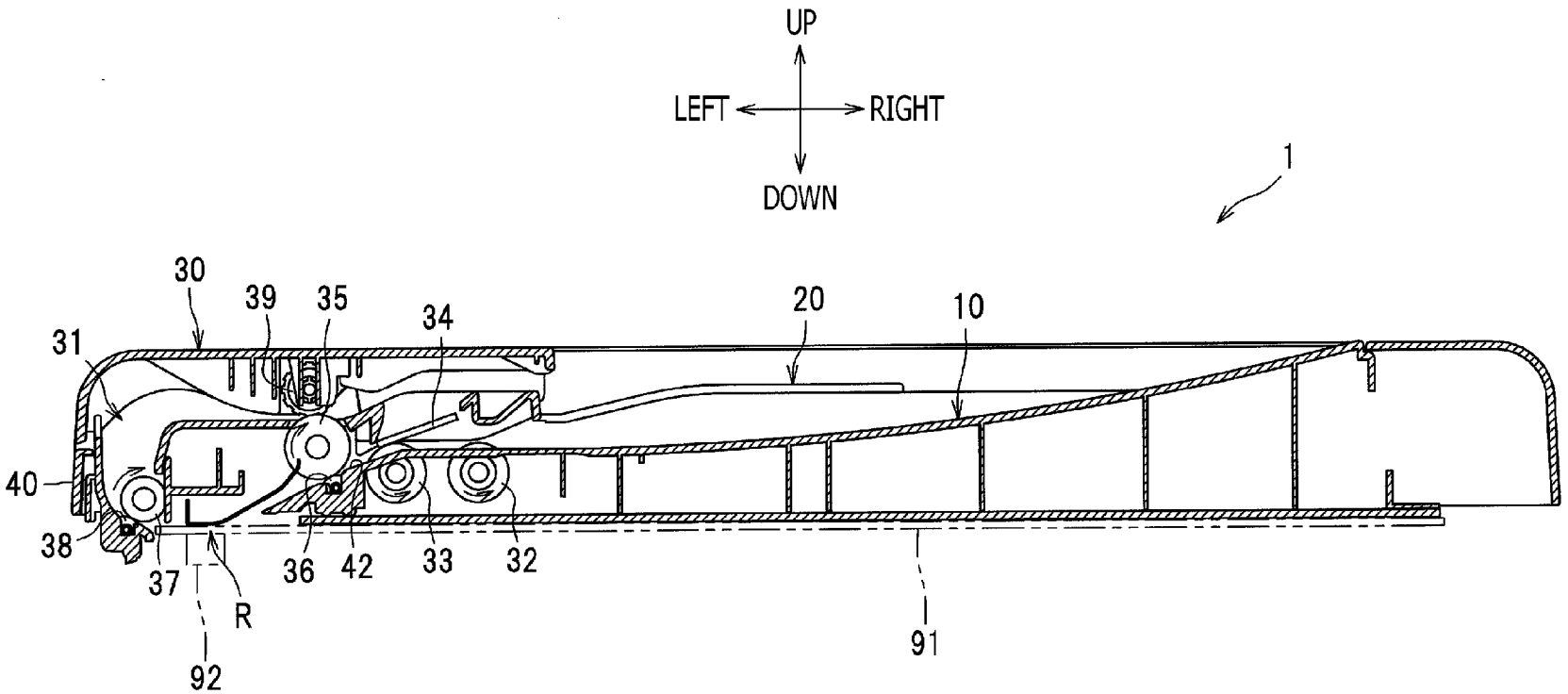
FIG. 2 is a cross-sectional view schematically showing an internal configuration of the ADF in the embodiment according to one or more aspects of the present invention.

As shown in FIG. 2, the document feeding unit 30 includes a conveyance path 31 that is formed substantially in a U-shape and configured to guide the document sheet M set on the feed tray 10 toward the catch tray 20. Along the conveyance path 31, disposed are a pickup roller 32, a separation roller 33, a separation nipping member 34, a first feed roller 35, a first pinch roller 36, a second feed roller 37, a second pinch roller 38, and an ejection pinch roller 39. A reading position R is between the first feed roller 35 and the second feed roller 37 on the conveyance path 31. The reading position R is located to face an image sensor 92 across a platen glass 91 that is a document table of the flatbed scanner. The image sensor 92 is configured to read out, in the reading position R, an image formed on the document sheet M being conveyed toward the catch tray 20 along the conveyance path 31.

Document sheets set on the feed tray 10 are fed into the document feeding unit 30 by the pickup roller 32. After separated on a sheet-by-sheet basis between the separation roller 33 and the separation nipping member 34, the document sheets are sequentially conveyed toward the first feed roller 35. Then, the document sheets are sequentially conveyed toward the reading position R while being pinched between the first feed roller 35 and the first pinch roller 36. Afterward, the document sheets are sequentially read by the image sensor 92 while passing through the reading position R, and then conveyed toward the catch tray 20 while being pinched between the second feed roller 37 and the second pinch roller 38. Thereafter, the document sheets are sequentially ejected out of the document feeding unit 30 by the ejection roller unit(s) 60, and put onto the catch tray 20.

<Detailed Configuration of ADF>

Hereinafter, a detailed configuration of the ADF 1 will be described. The ADF 1 includes the first feed roller 35, the first pinch roller 36, and a frame 40 that is made of resin and configured to rotatably support the first feed roller 35 and the first pinch roller 36.

The first feed roller 35 is configured to be driven to rotate by a driving force from a driving source such as a motor (not shown).

Figure 3:
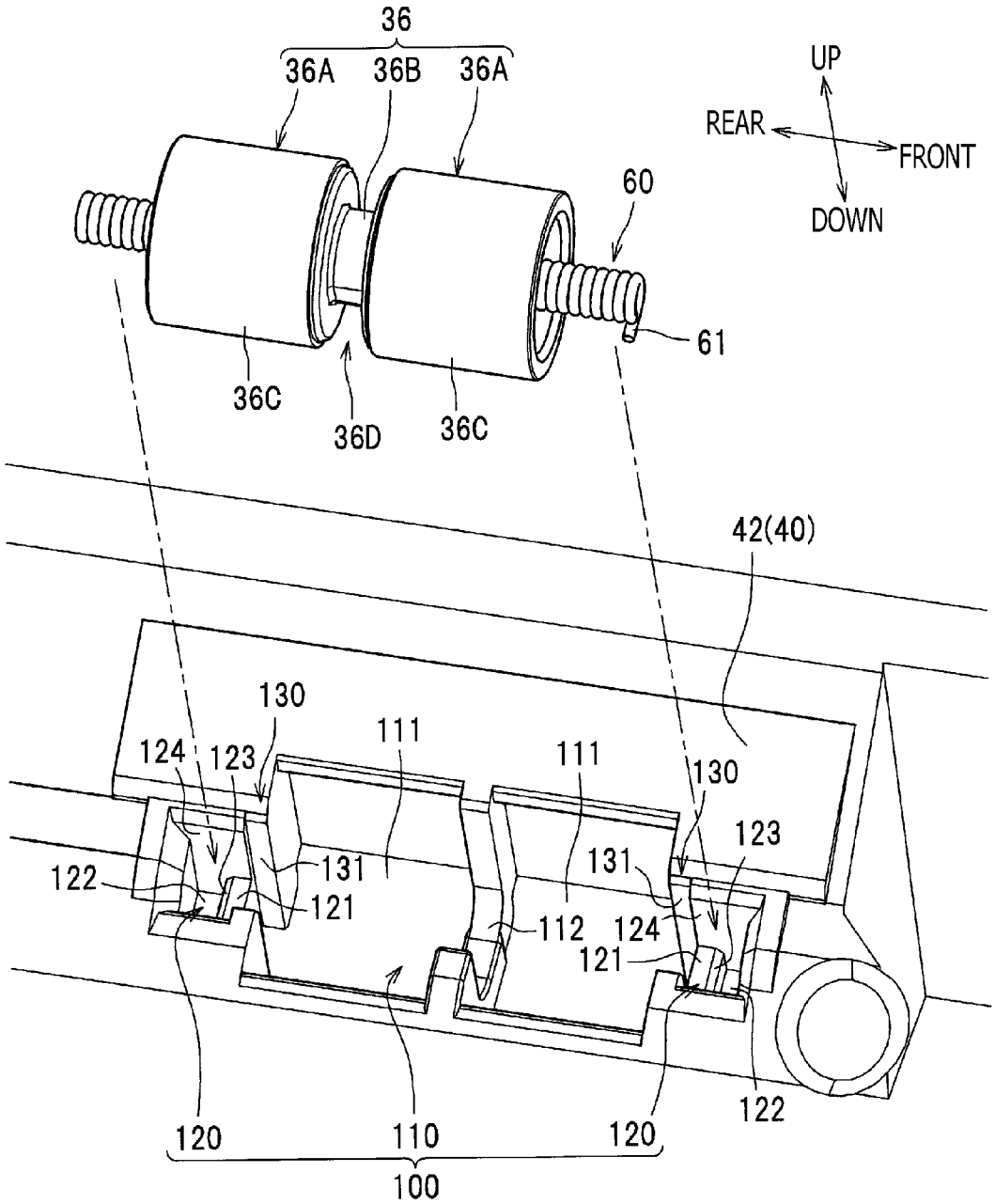
FIG. 3 is a perspective view showing a first pinch roller and a roller attachment portion in the embodiment according to one or more aspects of the present invention.

The first pinch roller 36 is disposed at a lower right side of the first feed roller 35. The first pinch roller 36 is configured to be rotated in accordance with rotation of the first feed roller 35. More specifically, as shown in FIG. 3, the first pinch roller 36 is formed substantially in a cylindrical shape including two roller portions 36A and a joint portion 36B. The two roller portions 36A are arranged along an axial direction of the first pinch roller 36. Further, the two roller portions 36A are configured to feed a document sheet while pinching the document sheet with the first feed roller 35. The joint portion 36B is configured to connect the two roller portions 36A. Further, the joint portion 36B has a smaller diameter than the roller portions 36A.

Figure 4A:
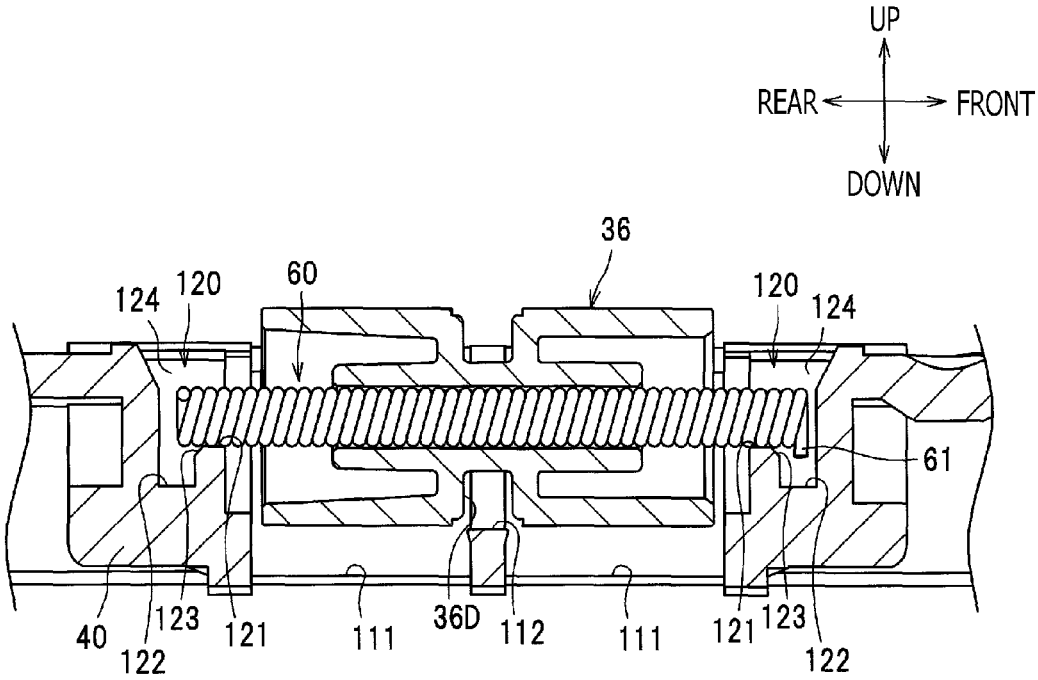
FIG. 4A is a cross-sectional view showing a state where the first pinch roller is attached to the roller attachment portion in the embodiment according to one or more aspects of the present invention.
Figure 4B:
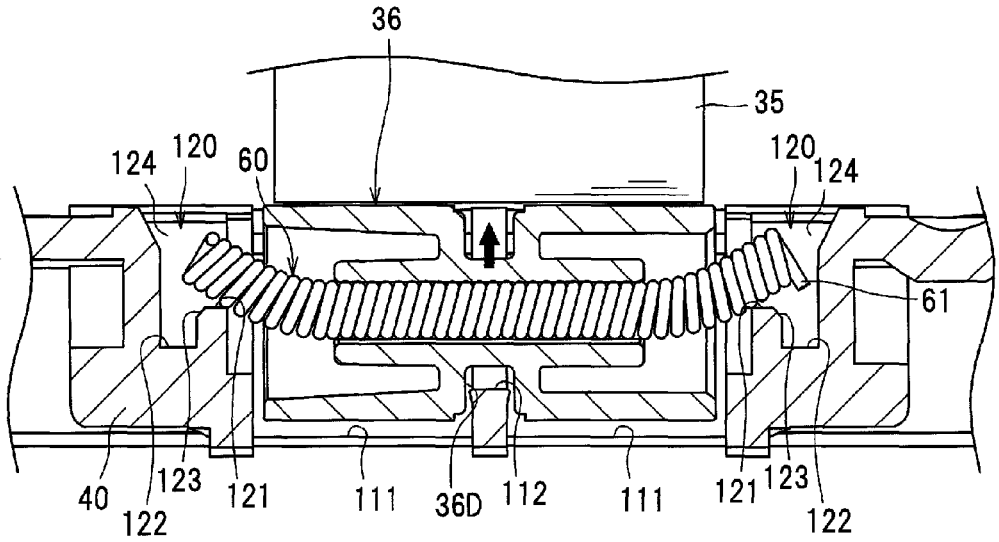
FIG. 4B is a cross-sectional view showing a state where an elastic shaft is deformed when a first feed roller is attached in the embodiment according to one or more aspects of the present invention.

Through the first pinch roller 36, an elastic shaft 60 is inserted in a rotatable manner. As shown in FIG. 4A, when both end portions in an axial direction of the elastic shaft 60 are supported by below-mentioned two bearings 120, respectively, the first pinch roller 36 is supported to be rotatable relative to the frame 40. Further, as shown in FIG. 4B, when the first feed roller 35 is attached to the frame 40, the first pinch roller 36 is pressed down, and the elastic shaft 60 is elastically bent. Hence, the first pinch roller 36 presses the first feed roller 35 by a restoring force of the elastic shaft 60. Thereby, the first pinch roller 36 is allowed to be rotated in accordance with rotation of the first feed roller 35 and feed a document sheet while pinching the document sheet with the first feed roller 35.

Figure 5:
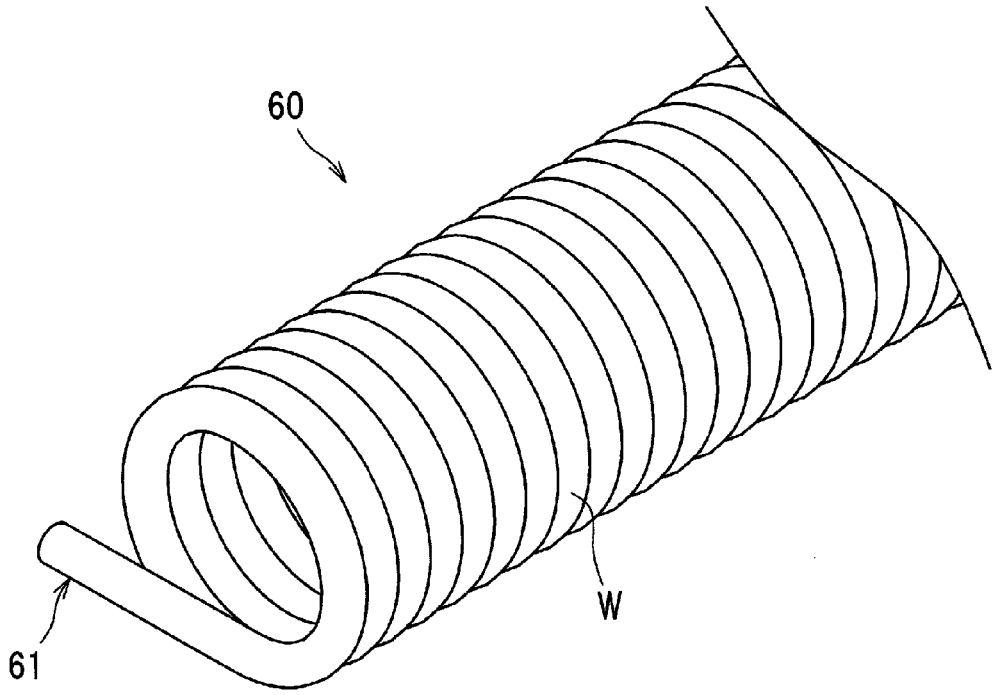
FIG. 5 is an enlarged perspective view showing one end of the elastic shaft at which a protrusion is formed in the embodiment according to one or more aspects of the present invention.
Figure 7A:
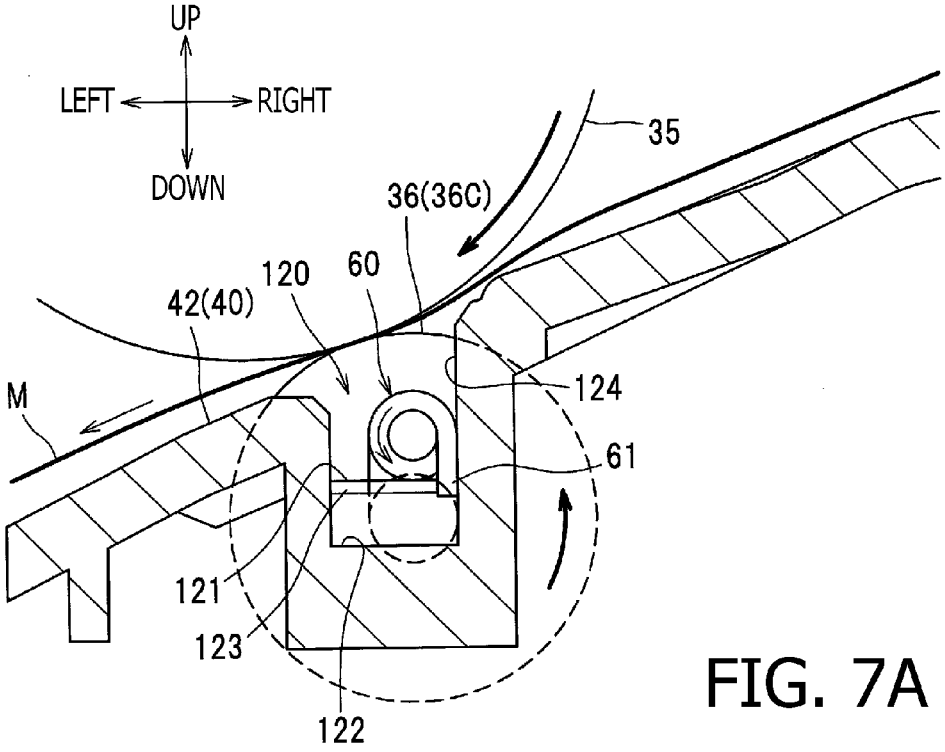
FIG. 7A is a front view showing a situation where a document sheet is conveyed while being pinched between the first feed roller and the first pinch roller in the embodiment according to one or more aspects of the present invention.

The elastic shaft 60 is a coil spring. The elastic shaft 60 includes, at one end thereof (in the embodiment, at a front end thereof), a protrusion 61 protruding outward in a radial direction of the first pinch roller 36. More specifically, as shown in FIG. 5, the protrusion 61 is formed by one end of a spirally-coiled wire W (which forms the elastic shaft 60 as a coil spring) being radially protruded outward from a spirally-coiled body of the elastic shaft 60. Further, as shown in FIG. 7A, in a situation where the document sheet M is fed while being pinched between the first feed roller 35 and the first pinch roller 36, the protrusion 61 is formed with such a length as not to protrude outward beyond feeding surfaces 36C of the first pinch roller 36 (i.e., outer circumferential surfaces of the roller portions 36A), in a view along the axial direction of the elastic shaft 60. More specifically, the protrusion 61 is formed with such a length as not to protrude to a side of the first feed roller 35 beyond the feeding surfaces 36C of the first pinch roller 36 in a view along the axial direction of the elastic shaft 60. It is noted that, in the embodiment, there is not a projection formed at the other end (in the embodiment, the rear end) of the elastic shaft 60.

As shown in FIG. 3, the frame 40 includes a recessed roller attachment portion 100 formed in a guide surface 42 that forms a part of the conveyance path 31, so as to allow the first pinch roller 36 to be attached to the frame 40. The roller attachment portion 100 includes a roller compartment 110 configured to accommodate the first pinch roller 36, and two bearings 120 configured to support both the end portions in the axial direction of the elastic shaft 60, respectively.

The roller compartment 110 includes two roller acceptors 111 and a joint acceptor 112. The two roller acceptors 111 are configured to accept (accommodate) the roller portions 36A of the first pinch roller 36. The joint acceptor 112 is formed to protrude from inner surfaces of the roller acceptors 111 and configured to accept (accommodate) the joint portion 36B. The first pinch roller 36, when attached to the frame 40, is positioned in the axial direction of the first pinch roller 36 by a groove-shaped recessed portion 36D engaging with the joint acceptor 112. The groove shape of the recessed portion 36D is defined by the two roller portions 36A and the joint portion 36B.

As shown in FIGS. 3 and 4, the two bearings 120 are formed to be mirror-symmetric with respect to a place perpendicular to the axial direction of the elastic shaft 60 (i.e., the front-to-rear direction). Each bearing 120 includes a shaft supporter 121, a concave portion 122, and a slanted surface 123. The shaft supporters 121 are configured to support, from beneath, the elastic shaft 60. Each shaft supporter 121 is formed as a surface substantially perpendicular to the vertical direction.

Each concave portion 122 is disposed outside the corresponding shaft supporter 121 in the axial direction of the elastic shaft 60. Further, each concave portion 122 is formed in a shape recessed outward in the radial direction of the first pinch roller 36, more specifically, in a downward-recessed shape. The concave portions 122 are configured to face the respective end portions of the elastic shaft 60 when the elastic shaft 60 is supported by the bearings 120. Although detailed functions of the concave portions 122 will be described later, a right-side surface of surfaces forming each concave portion 122 is a contact surface 124 configured to contact the protrusion 61 of the elastic shaft 60.

Each slanted surface 123 is formed between the corresponding shaft supporter 121 and the corresponding concave portion 122. Further, each slanted surface 123 is slanted with respect to the shaft supporter so as to extend obliquely down toward a recessed region of the concave portion 122 from an outer end of the shaft supporter 121.

Figure 6A:
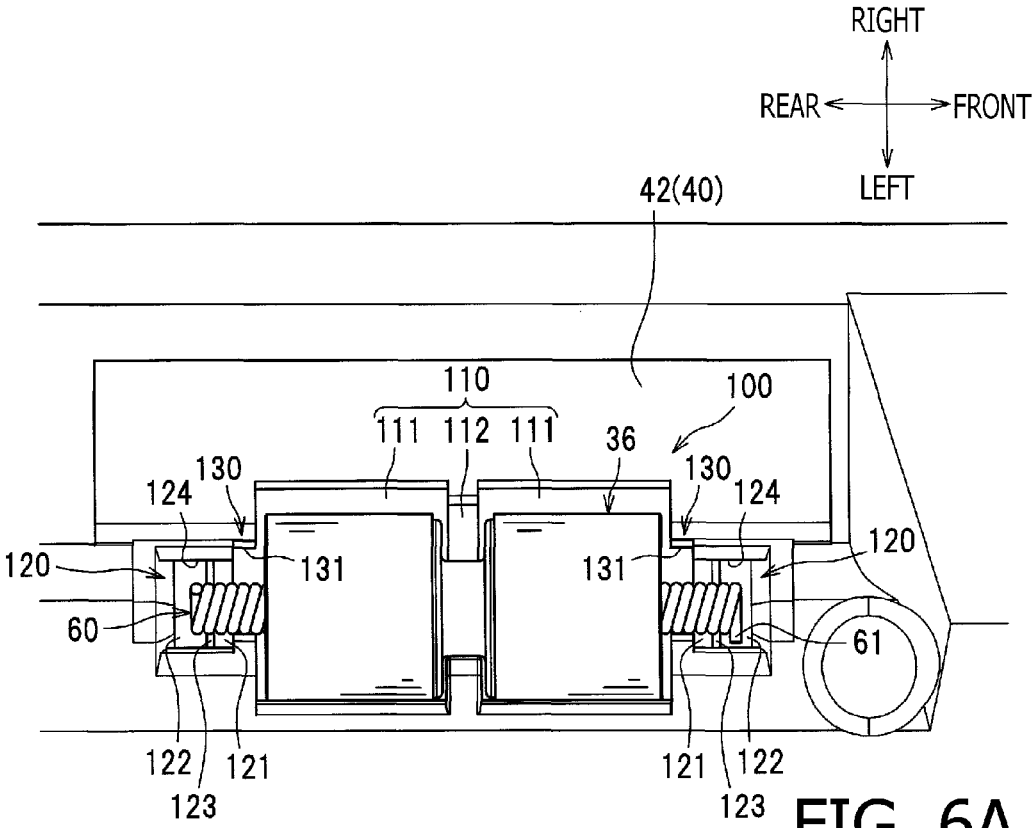
FIG. 6A is a top view showing the state where the first pinch roller is attached to the roller attachment portion in the embodiment according to one or more aspects of the present invention.

As shown in FIG. 6A, in the embodiment, the roller attachment portion 100 further includes shaft acceptors 130 each formed between the corresponding roller acceptor 111 and the corresponding bearing 120. Each shaft acceptor 130 includes a clearance portion 131 formed by a right-side surface of surfaces forming the shaft acceptor 130 being recessed rightward from the contact surface 124.

<Operations and Advantageous Effects of ADF>

Subsequently, an explanation will be provided about operations and advantageous effects of the ADF 1 configured as above. As shown in FIG. 3, according to the ADF 1 of the embodiment, it is possible to attach the first pinch roller 36 to the frame 40 by causing both the end portions in the axial direction of the elastic shaft 60 inserted through the first pinch roller 36 to support the two recess-shaped bearings 120. Thus, it is possible to more easily attach the first pinch roller 36 than such a configuration that hooks provided at an elastic shaft are hung on pins provided at a frame.

Further, in the embodiment, the slanted surface 123 is formed between the shaft supporter 121 and the concave portion 122 of each bearing 120. Therefore, when the elastic shaft 60 is supported by the bearings 120, the protrusion 61 is put into the concave portion 122 along the slanted surface 123 (e.g., of the front-side bearing 120). Thereby, it is possible to easily attach the first pinch roller 36 no matter what direction the protrusion 61 is oriented in.

Figure 6B:
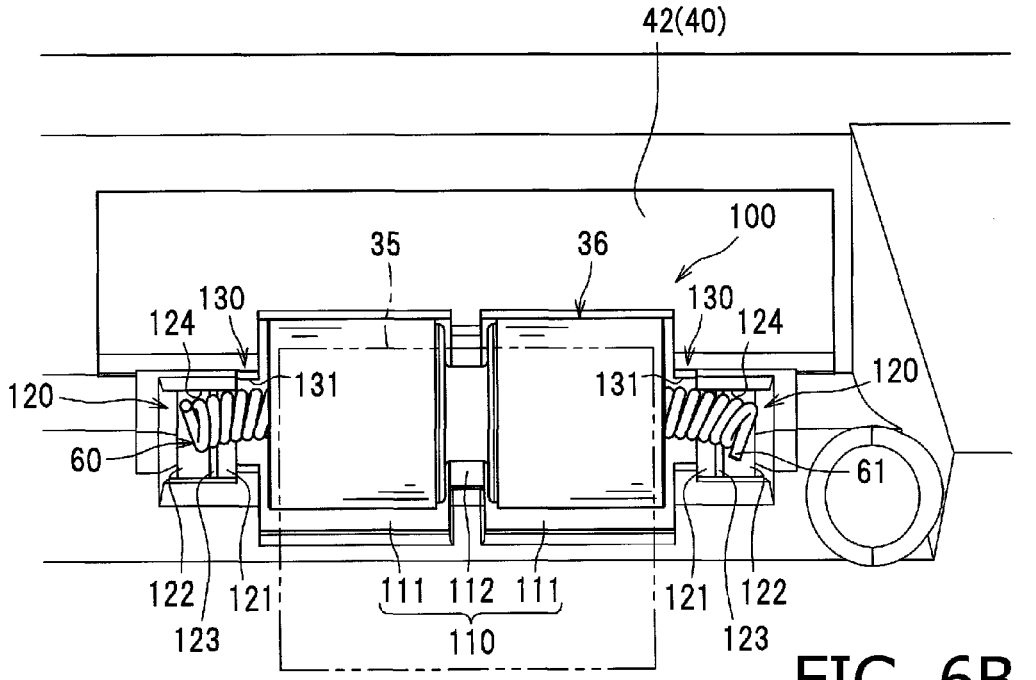
FIG. 6B is a top view showing the state where the elastic shaft is deformed when the first feed roller is attached in the embodiment according to one or more aspects of the present invention.

As shown in FIG. 6B, when the first feed roller 35 is attached to the frame 40, the first feed roller 35 is disposed at the upper left side of the first pinch roller 36. Thus, the first pinch roller 36 is pressed by the first feed roller 35 obliquely toward a lower right side. At this time, the elastic shaft 60 is bent with a middle portion thereof bulging rightward in a top view. Even in this situation, according to the embodiment, since the roller attachment portion 100 includes the clearance portions 131, it is possible to prevent contact between the elastic shaft 60 and right-side surfaces of the roller attachment portion 100.

As shown in FIG. 7A, when the document sheet M is conveyed toward the reading position R while pinched between the first feed roller 35 and the first pinch roller 36, the elastic shaft 60 is caused to rotate counterclockwise in FIG. 7A by friction with the first pinch roller 36. However, the elastic shaft 60 is prevented from rotating when the protrusion 61 contacts the contact surface 124 (e.g., of the front-side bearing 120).

Figure 7B:
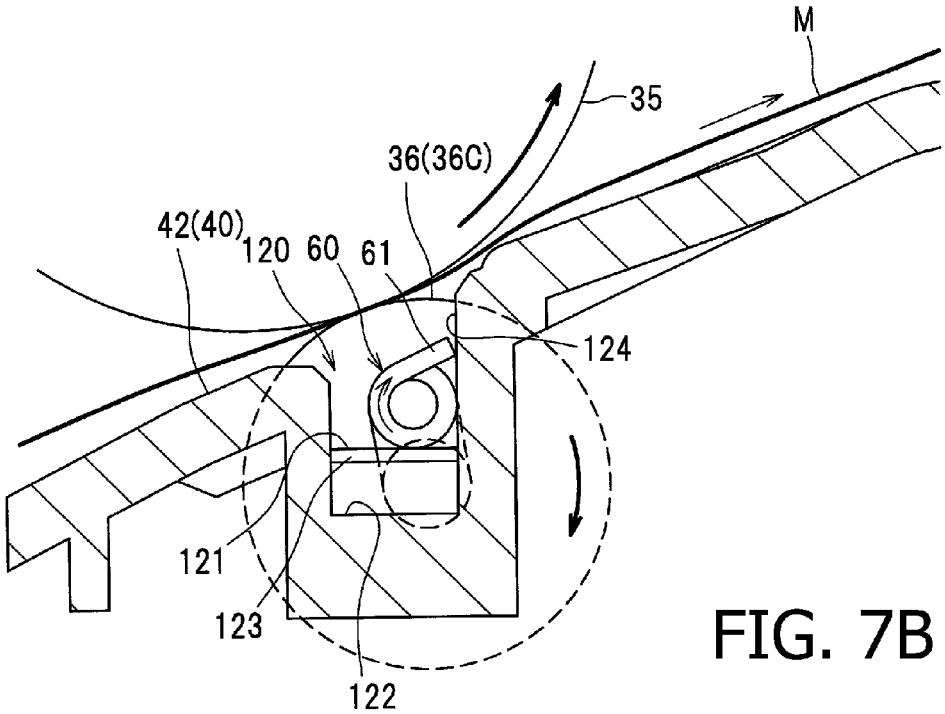
FIG. 7B is a front view showing a situation where a jammed document sheet is removed from between the first feed roller and the first pinch roller in the embodiment according to one or more aspects of the present invention.

Further, as shown in FIG. 7B, when the document sheet M is jammed between the first feed roller 35 and the first pinch roller 36, and a user pulls and removes the jammed document sheet M from a side of the feed tray 10, the first pinch roller 36 rotates clockwise in FIG. 7B, and the elastic shaft 60 is caused to rotate clockwise by friction with the first pinch roller 36. In this case, although the elastic shaft 60 is rotated about 180 degrees from its state shown in FIG. 7A, further rotation of the elastic shaft 60 is prevented as a distal end of the protrusion 61 contacts the contact surface 124 (e.g., of the front-side bearing 120).

Thus, according to the ADF 1 of the embodiment, when the elastic shaft 60 is caused to rotate by the rotation of the first pinch roller 36, the contact between the protrusion 61 and the contact surface 124 prevents the rotation of the elastic shaft 60. Hence, it is possible to prevent generation of undesired noises due to sliding contact of the elastic shaft 60 with the bearings 120.

Further, in the embodiment, the protrusion 61 of the elastic shaft 60 is formed with such a length as not to protrude to the side of the first feed roller 35 beyond the feeding surfaces 36C of the first pinch roller 36. Therefore, it is possible to prevent contact between the protrusion 61 and the document sheet M. Thereby, it is possible to prevent undesired noises or damages of the document sheet M from being caused by the contact between the protrusion 61 and the document sheet M.

Further, in the embodiment, each bearing 120 includes the shaft supporter 121 and the concave portion 122. Hence, it is possible to let the protrusion 61 of the elastic shaft 60 get into the concave portion 122. Thereby, the shaft supporters 121 are allowed to stably support inner portions of the elastic shaft 60 relative to the ends in the axial direction of the elastic shaft 60. Thus, it is possible to stabilize a load applied to the first feed roller 35 from the elastic shaft 60 via the first pinch roller 36.

Further, in the embodiment, the two bearings 120 are formed to be mirror-symmetric with respect to a place perpendicular to the axial direction of the first pinch roller 36 (i.e., the front-to-rear direction), and have the respective contact surfaces 124. Hence, when the first pinch roller 36 is attached to the bearings 120, the user needs not pay careful attention to what direction the elastic shaft 60 is oriented in (i.e., which side of the elastic shaft 60 the protrusion 61 is provided at). Therefore, referring to FIG. 3, for instance, it is possible to cause the end portion of the elastic shaft 60, at which the protrusion 61 is formed, to be supported by the rear-side bearing 120 instead of the front-side bearing 120. Thus, it is possible to more easily attach the first pinch roller 36 to the frame 40.

Further, in the embodiment, the protrusion 61 is formed by one end of the wire W, which is spirally coiled to form the elastic shaft 60 as a coil spring, being radially protruded outward from the spirally-coiled body of the elastic shaft 60. Therefore, it is possible to easily form the protrusion 61 at the elastic shaft 60.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible. It is noted that, in the following modifications, explanations of the same configurations as exemplified in the aforementioned embodiments will be omitted.

[Modifications]

In the aforementioned embodiment, each of the two bearings 120 has the contact surface 124. However, for instance, when the elastic shaft 60 has the protrusion 61 at only one end thereof in the axial direction as exemplified in the aforementioned embodiment, only one of the two bearings 120 that supports the end portion of the elastic shaft 60 at which the protrusion 61 is formed may have the contact surface 124.

In the aforementioned embodiment, the elastic shaft 60 has the protrusion 61 at only one end thereof in the axial direction. Nonetheless, for instance, the elastic shaft 60 may have the protrusion 61 at each end thereof in the axial direction. In this case, when the elastic shaft 60 is manufactured, careful attentions need to be paid to the positions of the two protrusions 61, and respective processes of forming the two protrusions 61 need to be performed at both the ends of the elastic shaft 60. However, when the elastic shaft 60 has the protrusion 61 at only one end thereof as exemplified in the aforementioned embodiment, there is no need for such careful attentions or forming processes. Thus, it is possible to more easily manufacture the elastic shaft 60 than when the elastic shaft 60 has the protrusion 61 at each end thereof.

In the aforementioned embodiment, the elastic shaft 60 is a coil spring. However, for instance, the elastic shaft 60 may be a bar-shaped elastically-bendable member such as a bar spring.

Further, for instance, each bearing 120 may not have the slanted surface 123 formed between the shaft supporter 121 and the concave portion 122.

In the aforementioned embodiment with the first feed roller 35 as a driving roller and the first pinch roller 36 as a driven roller, aspects of the present invention are applied to the first pinch roller 36 and the bearings 120. However, for instance, aspects of the present invention may be applied to the second pinch roller 38 and bearings for the second pinch roller 38 in a modification with the second feed roller 37 as a driving roller and the second pinch roller 38 as a driven roller in the ADF 1 as shown in FIG. 2.

In the aforementioned embodiment, aspects of the present invention are applied to the ADF 1. Nonetheless, for instance, aspects of the present invention may be applied to a sheet feeding mechanism for a printer or a copy machine.

What is claimed is:

1. A sheet feeder comprising:

a driving roller;

a driven roller configured to rotate in accordance with rotation of the driving roller and feed a sheet while pinching the sheet with the driving roller;

an elastic shaft inserted through the driven roller and configured to rotatably support the driven roller, the elastic shaft comprising a cylinder member having an axial parallel to an axial direction of the elastic shaft, and a protrusion formed on at least one end of the elastic shaft in the axial direction of the elastic shaft, the protrusion protruding outward relative to an outer circumference of the cylinder member in a radial direction of the cylinder member; and two recess-shaped bearings configured to support two end portions of the elastic shaft in the axial direction, respectively, at least one of the bearings comprising a contact surface configured to contact the protrusion when the elastic shaft is supported by the bearings and contact the cylindrical member and the protrusion when the driven roller is rotated.

2. The sheet feeder according to claim 1, wherein the at least one bearing comprising the contact surface, further comprises:

a shaft supporter configured to support the elastic shaft; and a concave portion disposed outside the shaft supporter in the axial direction of the elastic shaft, the concave portion formed in a shape recessed outward in the radial direction of the driven roller with respect to the shaft supporter and configured to face an end portion of the elastic shaft in the axial direction when the elastic shaft is supported by the bearings.

3. The sheet feeder according to claim 2, wherein the at least one bearing comprising the contact surface, further comprises:

a slanted surface formed between the shaft supporter and the concave portion, so as to be slanted with respect to the shaft supporter and extend from the shaft supporter toward a recessed region of the concave portion.

4. The sheet feeder according to claim 1, wherein the protrusion is formed with such a length as not to protrude to a side of the driving roller beyond a feeding surface of the driven roller in a view along the axial direction of the elastic shaft, in a situation where the sheet is fed while being pinched between the driving roller and the driven roller.

5. The sheet feeder according to claim 1, wherein the elastic shaft is a coil spring formed by a spirally coiled wire, and wherein the protrusion is formed by one end of the spirally-coiled wire radially protruding outwardly from a spirally-coiled body of the elastic shaft.

6. The sheet feeder according to claim 1, wherein the elastic shaft comprises the protrusion formed on only one end of the elastic shaft in the axial direction.

7. The sheet feeder according to claim 6, wherein each of the bearings comprises the contact surface.

8. The sheet feeder according to claim 5, wherein the protrusion is formed by a straightened portion of the one end of the spirally-coiled wire.

* * * * *